US006099280A

United States Patent [19]

Bernstrom et al.

[11] Patent Number: 6,099,280

[45] Date of Patent: Aug. 8, 2000

[54] TWO SPEED GEROTER MOTOR WITH EXTERNAL POCKET RECIRCULATION

[75] Inventors: Marvin L. Bernstrom, Eden Prairie; Jarett D. Millar; Karen J. Radford, both of Minneapolis; Ryan C. Bergerson, Eden Prairie, all of Minn.

[73] Assignee: Eaton Corporation, Cleveland, Ohio

[21] Appl. No.: 09/291,671

[22] Filed: Apr. 14, 1999

[51] Int. Cl.[7] ..... F01C 1/02

[52] U.S. Cl. ..... 418/61.3

[58] Field of Search ..... 418/61.3

[56] References Cited

U.S. PATENT DOCUMENTS

| | | | |
|---|---|---|---|
| 3,788,198 | 1/1974 | Giversen . | |
| 4,480,971 | 11/1984 | Swedberg . | |
| 4,715,798 | 12/1987 | Bernstrom . | |
| 4,741,681 | 5/1988 | Bernstrom | 418/61.3 |
| 4,756,676 | 7/1988 | Bernstrom | 418/61.3 |
| 5,516,268 | 5/1996 | Kassen et al. | 418/61.3 |
| 5,593,296 | 1/1997 | Bernstrom et al. | 418/61.3 |
| 5,624,248 | 4/1997 | Kassen et al. | 418/61.3 |

*Primary Examiner*—Thomas Denion
*Assistant Examiner*—Theresa Trieu
*Attorney, Agent, or Firm*—L. J. Kasper

[57] ABSTRACT

A two-speed gerotor motor of the type having a stationary valve member (19) defining a plurality of stationary valve passages, each including an upstream passage portion for commutating fluid communication with a moveable valve member (43), and a downstream passage portion in continuous fluid communication with a volume chamber (33) of the gerotor gear set. In some of the stationary valve passages (113), the upstream (115) and downstream (117) passage portions are blocked from direct fluid communication. A control valve spool (89) has a first position (FIG. 8) permitting unrestricted fluid communication between the upstream and downstream passage portions, for normal low-speed operation. The control valve spool has a second position (FIG. 9) blocking communication between the upstream (115) and downstream (117) passage portions, and connecting all of the downstream portions together, communicating with a fluid accumulation region (91), such that fluid from those volume chambers recirculates, to provide a high-speed mode of operation.

12 Claims, 9 Drawing Sheets

LOW SPEED

HIGH SPEED

TWO SPEED GEROTER MOTOR WITH EXTERNAL POCKET RECIRCULATION

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to rotary fluid pressure devices of the type in which a gerotor gear set serves as the fluid displacement mechanism, and more particularly, to such devices which are provided with two speed capability.

Although the teachings of the present invention can be applied to devices having fluid displacement mechanisms other than gerotors, such as cam lobe type devices, the invention is especially adapted to gerotor devices and will be described in connection therewith.

Devices utilizing gerotor gear sets can be used in a variety of applications, one of the most common being to use the device as a low-speed, high-torque motor. One common application for low-speed, high-torque gerotor motors is vehicle propulsion, wherein the vehicle includes an engine driven pump which provides pressurized fluid to a pair of gerotor motors, with each motor being associated with one of the drive wheels. Those skilled in the art will be aware that many gerotor motors utilize a roller gerotor, especially on larger, higher torque motors of the type used in propel applications, and subsequent references hereinafter to "gerotors" will be understood to mean and include both conventional gerotors, as well as roller gerotors.

In recent years, there has been a desire on the part of the vehicle manufacturers to be able to provide both the low-speed, high-torque mode of operation, such as when the vehicle is at the work site, and also a high-speed, low-torque mode of operation, for when the vehicle is traveling between work sites. One possible solution has been to provide a gerotor motor having a two-speed capability.

Two-speed gerotor motors are known from U.S. Pat. No. 4,480,971, assigned to the assignee of the present invention and incorporated herein by reference. The device of the cited patent has been in widespread commercial use and has performed in a generally satisfactory manner. As is well known to those skilled in the art, a gerotor motor may be operated as a two speed device by providing valuing which can effectively "recirculate" fluid between expanding and contracting fluid volume chambers of the gerotor gear set. In other words, if the inlet port communicates with all of the expanding chambers, and all of the contracting chambers communicate with the outlet port, the motor operates in the normal low-speed, high-torque mode. If some of the fluid from the contracting chambers is recirculated back to some of the expanding chambers, the result will be operation in a high-speed, low-torque mode, which is the same result as if the displacement of the gerotor were decreased, but with the same flow rate through the gerotor.

In the two-speed gerotor motors which are in use commercially, and as shown in the above-cited patent, each volume chamber within the gerotor gear set has the opportunity to be a "recirculating" volume chamber, both as the volume chamber expands and as it contracts, while the motor is operating in the high-speed, low-torque mode. One result of each volume chamber being a recirculating volume chamber is a condition referred to as "oddly spaced" recirculating volume chambers which, it is believed, has led to an uneven torque ripple when operating in the high-speed, low-torque mode.

Accordingly, it is an object of the present invention to provide an improved two speed arrangement, especially suited for use with a gerotor motor, which will eliminate or substantially reduce the undesirable effects of the "oddly spaced" recirculating volume chambers, including reducing the unevenness of the torque ripple in the high-speed, low-torque mode.

As a result of the present invention, it is now understood that another disadvantage of the prior art two speed arrangements is that, in the prior art devices, all recirculating flow would have to pass through the commutating valuing. As is well understood by those skilled in the art, the fact that some fluid is recirculating in the high-speed, low-torque mode means that the total flow is substantially greater in the high speed mode. Unfortunately, in the typical, prior art arrangements, the addition of the two speed capability has resulted in valuing passages which are somewhat constricted in terms of flow capacity, by comparison to a conventional motor of the same speed and torque capacity. The result has been an undesirable increase in the pressure drop across the prior art two speed motors and, as is well known to those skilled in the art, the higher the pressure drop across a hydraulic motor, the less commercially desirable is the motor.

Accordingly, it is another object of the present invention to provide an improved two speed arrangement which does not require more constricted commutating valve passages, and therefor, does not result in an increased pressure drop across the motor.

BRIEF SUMMARY OF THE INVENTION

The above and other objects of the invention are accomplished by the provision of an improved fluid pressure operated device comprising housing means defining a fluid inlet port and a fluid outlet port. A fluid pressure displacement mechanism is associated with the housing means and includes an internally toothed ring member and an externally toothed star member eccentrically disposed within the ring member. The ring member and the star member have relative orbital and rotational movement and interengage to define a plurality N of expanding and contracting fluid volume chambers in response to the orbital and rotational movement. A motor valve means cooperates with the housing means to provide fluid communication between the fluid inlet port and the expanding volume chambers and between the contracting volume chambers and the fluid outlet port. The motor valve means comprises a stationary valve member fixed to be non-rotatable relative to the housing means, and a moveable valve member operable to move relative to the stationary valve member in synchronism with one of the orbital and rotational movements. The stationary valve member defines a plurality N of stationary valve passages, each of said stationary valve passages including an upstream passage portion adapted for commutating fluid communication with the moveable valve member, and further including a downstream passage portion in continuous fluid communication with one of the plurality N of fluid volume chambers. In a plurality N–M of the stationary valve passages, the upstream passage portion and the downstream passage portion are in direct, relatively unrestricted, continuous fluid communication.

The improved fluid pressure operated device is characterized by, in a plurality M of the stationary valve passages, the upstream and downstream passage portions are blocked from direct fluid communication. Control valve means is operably associated with the stationary valve member, and operable in a first position to provide relatively unrestricted communication between each upstream passage portion and its respective downstream passage portion. The control valve means is operable in a second position to block fluid communication between each upstream passage portion and its respective downstream passage portion.

In the prior art two-speed gerotor motor arrangements, the "ratio" in the low-speed, high-torque mode is, by definition, 1.0:1, and the ratio in the high-speed, low-torque mode is determined by the number of volume chambers which recirculate (as a percentage of the total number of volume chambers). In the prior art arrangements, the shift between the low speed and high speed modes has occurred fairly abruptly and the prior art design has effectively dictated that operation of the motor can occur in only the low speed and high speed modes.

Accordingly, it is another object of the present invention to provide an improved two-speed gerotor motor arrangement having at least the theoretical capability of providing for one or more operating ratios between a minimum speed ratio and a maximum speed ratio.

BRIEF DESCRIPTION OF THE DRAWINGS

FIGS. 8 and 9 are somewhat schematic views, similar to FIGS. 4 and 7, illustrating the two speed gerotor motor of the present invention in the low speed and high speed modes, respectively.

DETAILED DESCRIPTION OF THE PREFERRED EMBODIMENT

Figure 1:
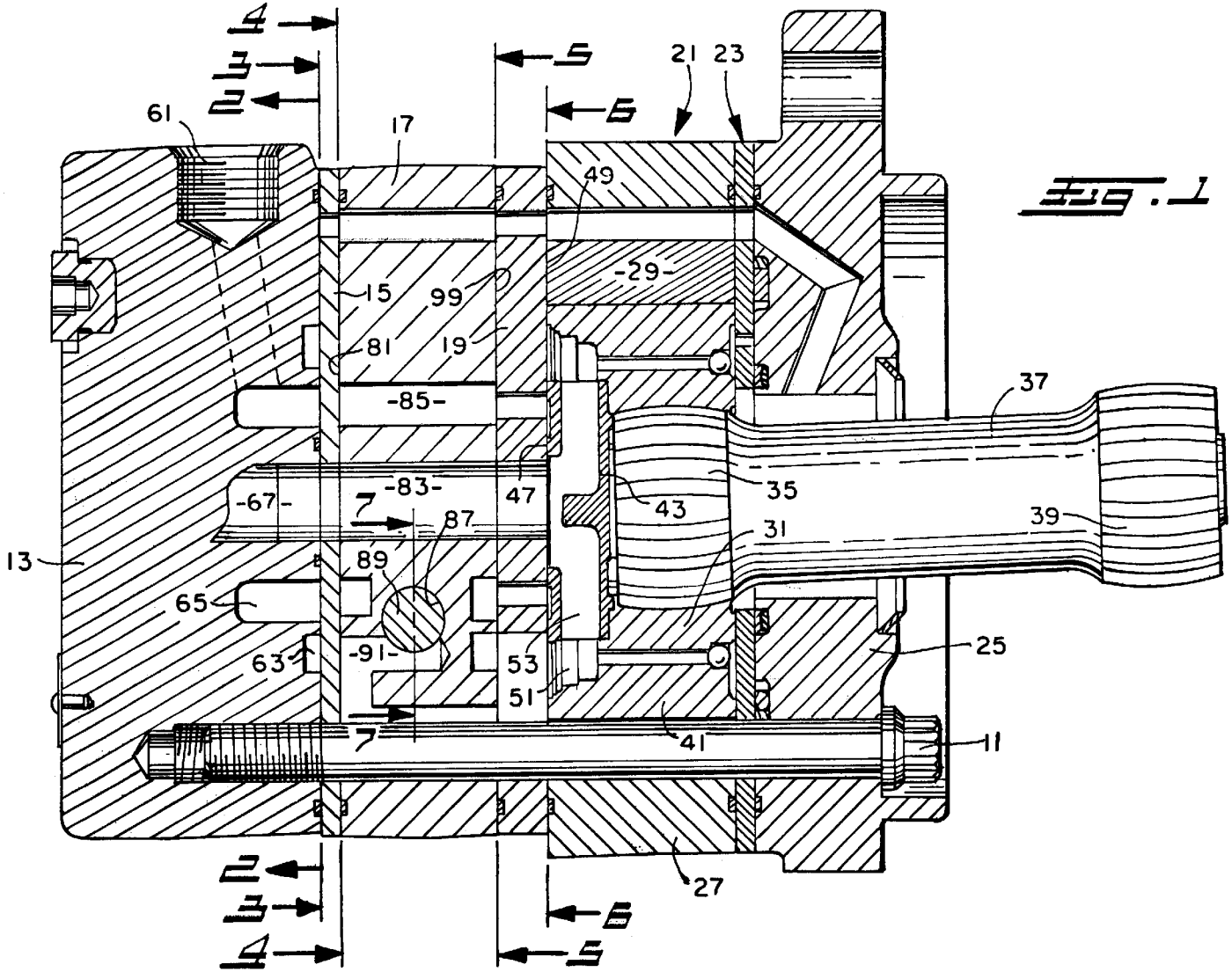
FIG. 1 is an axial cross-section of a low speed, high torque gerotor motor made in accordance with the teachings of the present invention.

Referring now to the drawings, which are not intended to limit the invention, FIG. 1 illustrates a valve-in-star (VIS) type of low speed, high torque motor, made generally in accordance with the above-incorporated patent, and more specifically, in accordance with U.S. Pat. No. 5,211,551, also assigned to the assignee of the present invention, and incorporated herein by reference.

The VIS motor shown in FIG. 1 comprises a plurality of sections secured together such as by a plurality of bolts 11, only one of which is shown in FIG. 1. The motor includes an end cap 13, a spacer plate 15, a shifter plate 17 (which may also be referred to as a "selector plate"), a stationary valve plate 19, a gerotor gear set, generally designated 21, a balancing plate assembly 23 and a flange member 25.

Figure 1A:
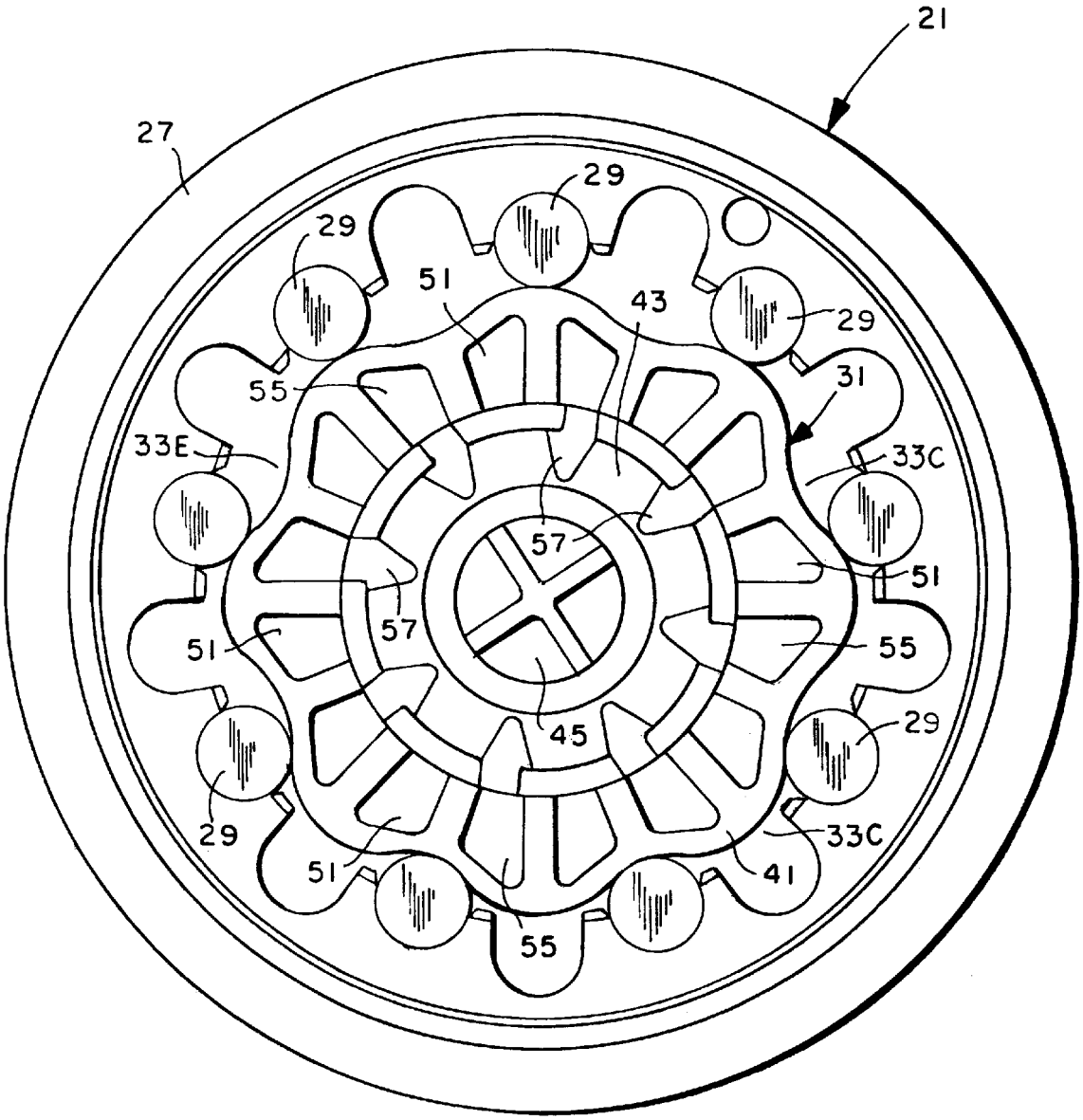
FIG. 1A is a transverse, plan view of the gerotor gear set, viewed from the left in FIG. 1, and on a slightly larger scale than FIG. 1.

The gerotor gear set 21, best seen in FIG. 1A, is well known in the art, is shown and described in greater detail in the above-incorporated patents, and therefore will be described only briefly herein. The gear set 21 is preferably a Geroler® gear set comprising an internally toothed ring member 27 defining a plurality of generally semi-cylindrical openings, with a cylindrical roller member 29 disposed in each of the openings, and serving as the internal teeth of the ring member 27. Eccentrically disposed within the ring member 27 is an externally-toothed star member 31, typically having one less external tooth than the number of internal teeth or rollers 29, thus permitting the star member 31 to orbit and rotate relative to the ring member 27. The orbital and rotational movement of the star 31 within the ring 27 defines a plurality of fluid volume chambers 33, each of which, at any given instant in time, is either an expanding volume chamber 33E, or a contracting volume chamber 33C. However, as is well known to those skilled in the art, there is also, at any given instant in time, one of the volume chambers which is in a state of "transition" between expanding and contracting. In the subject embodiment, and by way of example only, there is a total of nine volume chambers 33.

Referring still primarily to FIG. 1, the star 31 defines a plurality of straight, internal splines which are in engagement with a set of external, crowned splines 35, formed on one end of a main drive shaft 37. Disposed at the opposite end of the shaft 37 is another set of external, crowned splines 39, adapted to be in engagement with another set of straight, internal splines defined by some form of rotary output member, such as a shaft or wheel hub (not shown).

Referring again primarily to FIG. 1A, in conjunction with FIG. 1, the star member 31 will be described in some additional detail. Although not an essential feature of the present invention, the star 31, in the subject embodiment, comprises an assembly of two separate parts, including a main star portion 41, which includes the external teeth, and an insert or plug 43 (the relationship therebetween being best shown in FIG. 1). The main portion 41 and the insert 43 cooperate to define the various fluid zones, passages, and ports which will be described subsequently. The star member 31 defines a central manifold zone 45, defined by an end surface 47 of the star 31, the end surface 47 being disposed in sliding, sealing engagement with an adjacent surface 49 (see FIGS. 1 and 6) of the stationary valve plate 19.

The end surface 47 of the star 31 defines a set of fluid ports 51, each of which is in continuous fluid communication with the manifold zone 45 by means of a fluid passage 53 defined by the insert 43. The end surface 47 further defines a set of fluid ports 55 which are arranged alternately with the fluid ports 51, each of the fluid ports 55 including a portion 57 which extends radially inward, about halfway to the manifold zone 45. The portions 57 together define an "outer" manifold zone, surrounding the inner or central manifold zone 45.

Figure 2:
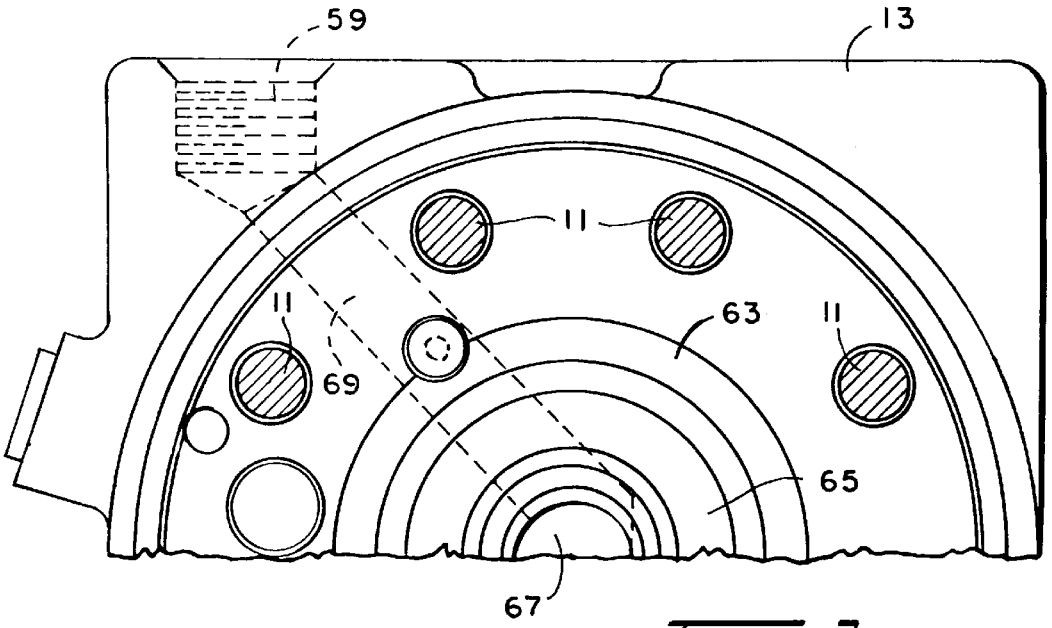
FIG. 2 is a transverse cross-section, showing only the upper half of the motor of FIG. 1, and taken on line 2—2 of FIG. 1.

Referring now to FIG. 2, in conjunction with FIG. 1, the end cap 13 includes a fluid inlet port 59 and a fluid outlet port 61, although those skilled in the art will recognize that most motors of the type to which the invention relates are meant to be "bi-directional" in operation, such that the ports may be reversed. The end cap 13 defines an annular chamber 63 which is in open, continuous fluid communication with the inlet port 59. The end cap 13 also defines an annular chamber 65 (see FIG. 1) which is in open, continuous fluid communication with the outlet port 61. Finally, the end cap 13 defines a cylindrical chamber 67 which is also in continuous, open fluid communication with the inlet port 59. The cylindrical chamber 67 and the annular chamber 63 communicate with the inlet port 59 by means of a passage 69 (see FIG. 2). It is considered a desirable feature of the present invention for the annular chamber 63 to be in continuous fluid communication with a source of relatively high pressure fluid, such as the motor inlet port 59, for reasons which will become apparent subsequently.

Figure 3:
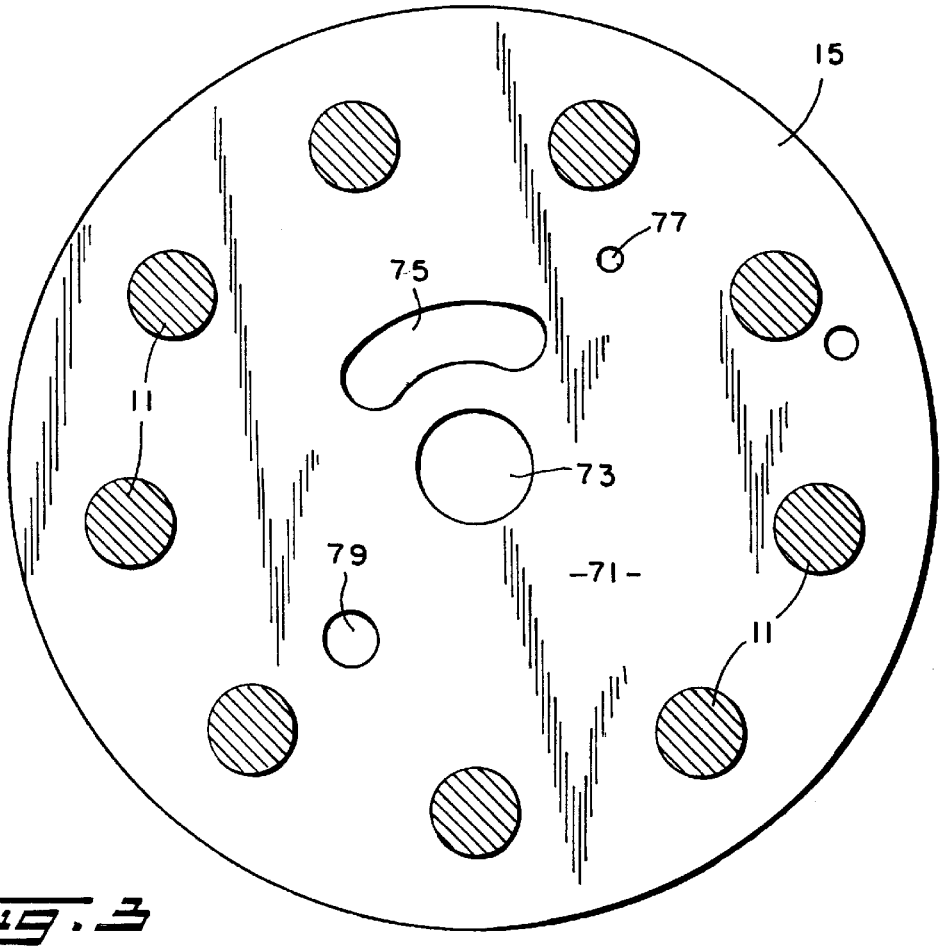
FIG. 3 is a transverse cross-section, taken on line 3—3 of FIG. 1, and showing a plan view of the spacer plate.

Referring now primarily to FIG. 3, the spacer plate 15 has a surface 71 which is disposed in sealing engagement with the adjacent surface of the end cap 13, shown in FIG. 2. The spacer plate 15 defines a central opening 73 which permits communication with the cylindrical chamber 67. Disposed above the central opening in FIG. 3 is a kidney-shaped passage 75, the function of which will be described subsequently. The spacer plate 15 also defines a small hole 77 and a relatively larger hole 79, both of the holes 77 and 79 being generally open to the annular chamber 63, as will be described further.

Figure 4:
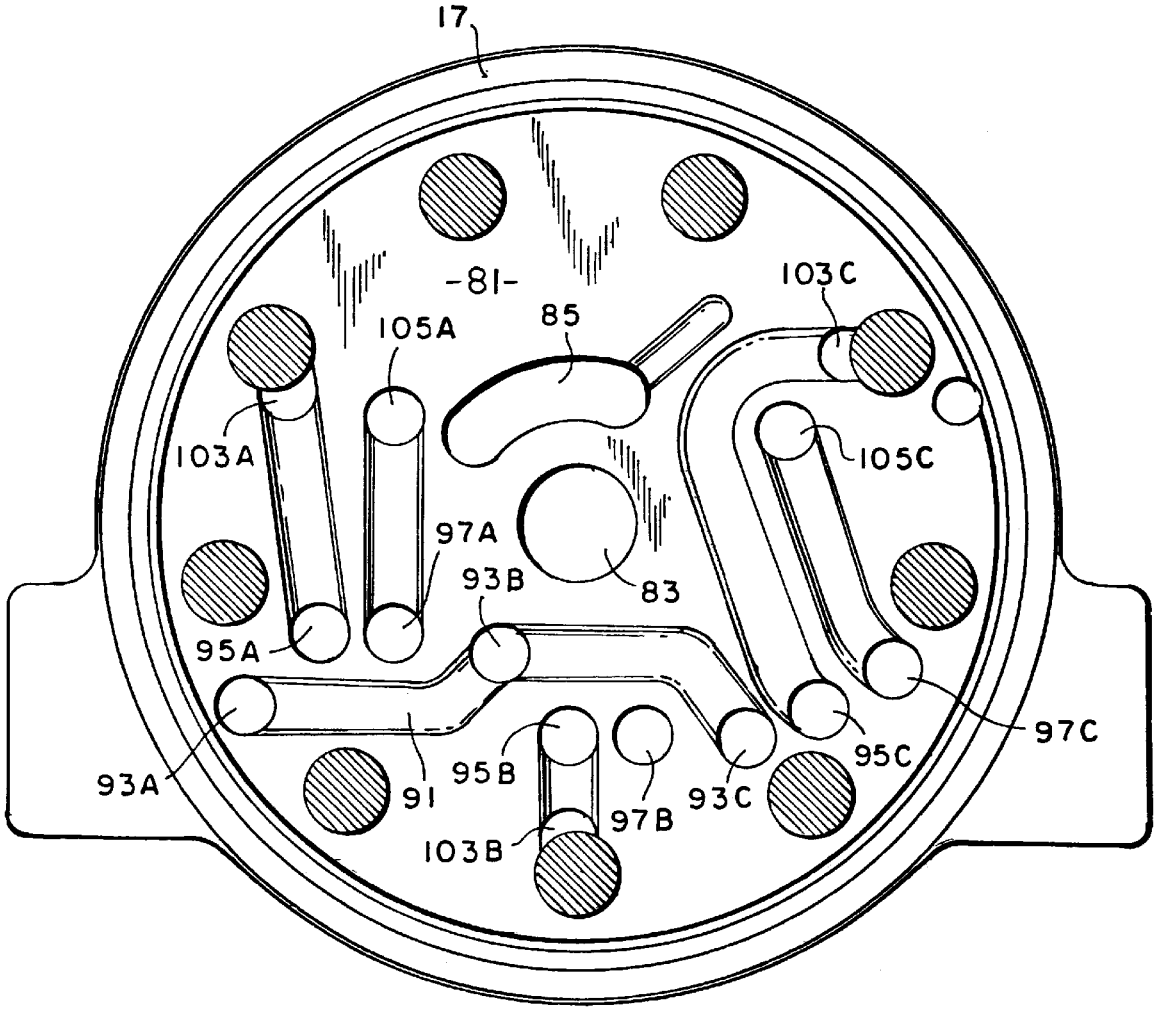
FIG. 4 is a transverse cross-section, taken on line 4—4 of FIG. 1, and illustrating the shifter plate which comprises part of the present invention.

Referring now primarily to FIG. 4, the shifter plate 17 will be described in some detail. The shifter plate 17 has a surface 81 disposed in sealing engagement with the spacer plate 15. The shifter plate 17 defines a central opening 83 in open communication with the central opening 73 of the spacer plate 15. The shifter plate 17 also defines a kidney-shaped passage 85 in open communication with the passage 75. As may best be seen in FIGS. 1 and 7, the shifter plate 17 defines a spool bore 87, having a control valve spool 89 slidably disposed within the bore 87.

Surface 81 of the shifter plate 17 defines a recirculation passage 91, which receives high pressure fluid from the annular chamber 63 through the large hole 79, such that the recirculation passage 91 always contains relatively high pressure (inlet pressure). The recirculation passage 91, in conjunction with the annular chamber 63, functions somewhat as an accumulator, as will be described subsequently. Extending axially from the recirculation passage 91, and intersecting the spool bore 87 is a plurality of recirculation bores 93A, 93B and 93C. Also extending from the surface 81 and intersecting the spool bore 87 is a plurality of pocket bores 95A, 95B, and 95C. The term "pocket" is used herein as an alternative term for "volume chamber", i.e., the pocket bores 95A, 95B and 95C are in open, continuous fluid communication with three of the volume chambers 33, as will be described further subsequently. Also extending from the surface 81 and intersecting the spool bore 87 is a plurality of valve bores 97A, 97B and 97C, the term "valve" being used herein because the bores 97A, 97B, and 97C are in fluid communication with the commutating valuing, shown in FIG. 1A and described previously.

Figure 5:
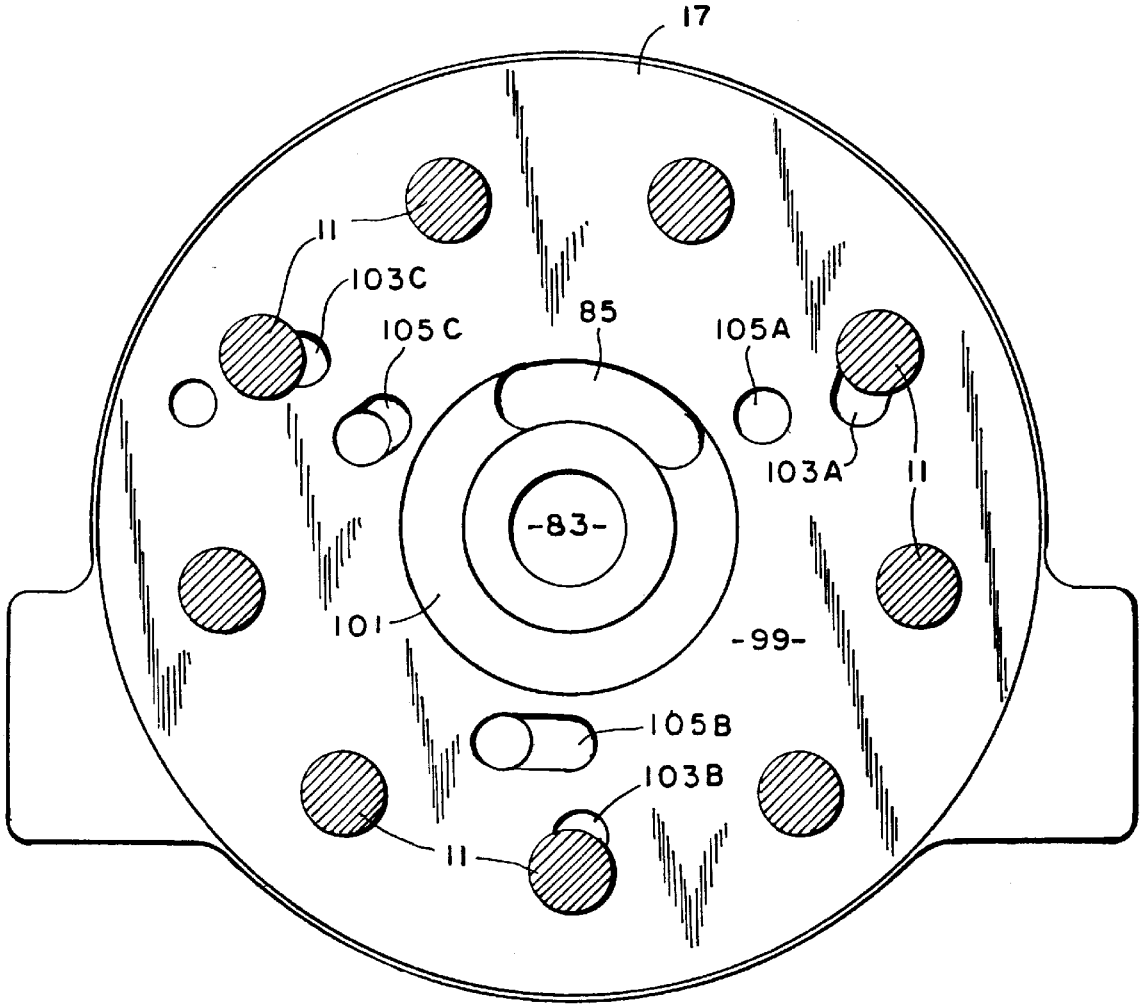
FIG. 5 is a transverse cross-section taken on line 5—5 of FIG. 1, showing the opposite surface of the shifter plate shown in FIG. 4.

Referring now to FIGS. 4 and 5 together, FIG. 5 shows a surface 99 of the shifter plate 17, the surface 99 being oppositely disposed from the surface 81, and as may be seen in FIG. 1, FIGS. 4 and 5 are viewed in opposite directions. The surface 99 defines an annular groove 101 in fluid communication with the kidney-shaped passage 85. The shifter plate 17 also defines a number of openings or ports which are in fluid communication with the various pocket bores and valve bores defined on the surface 81 of the shifter plate 17, and which are shown in FIG. 4. The use of the letters A, B and C in describing the ports shown in FIG. 5 will be understood as an indication of a connection of those ports to the respective bores shown in FIG. 4. Therefore, the surface 99 of the shifter plate 17 defines a plurality of pocket ports 103A, 103B and 103C. In addition, the surface 99 defines a plurality of valve ports 105A, 105B and 105C.

Referring again primarily to FIG. 4, it should be noted that the pocket ports 103A, 103B and 103C extend throughout the entire axial length of the shifter plate 17, and thus the reference numerals 103A, 103B and 103C also appear in FIG. 4. It should also be noted that the surface 81 of the shifter plate 17 defines a plurality of passages interconnecting the various bores and ports. For ease of illustration, the passages defined by the surface 81 will not bear separate reference numerals.

Figure 6:
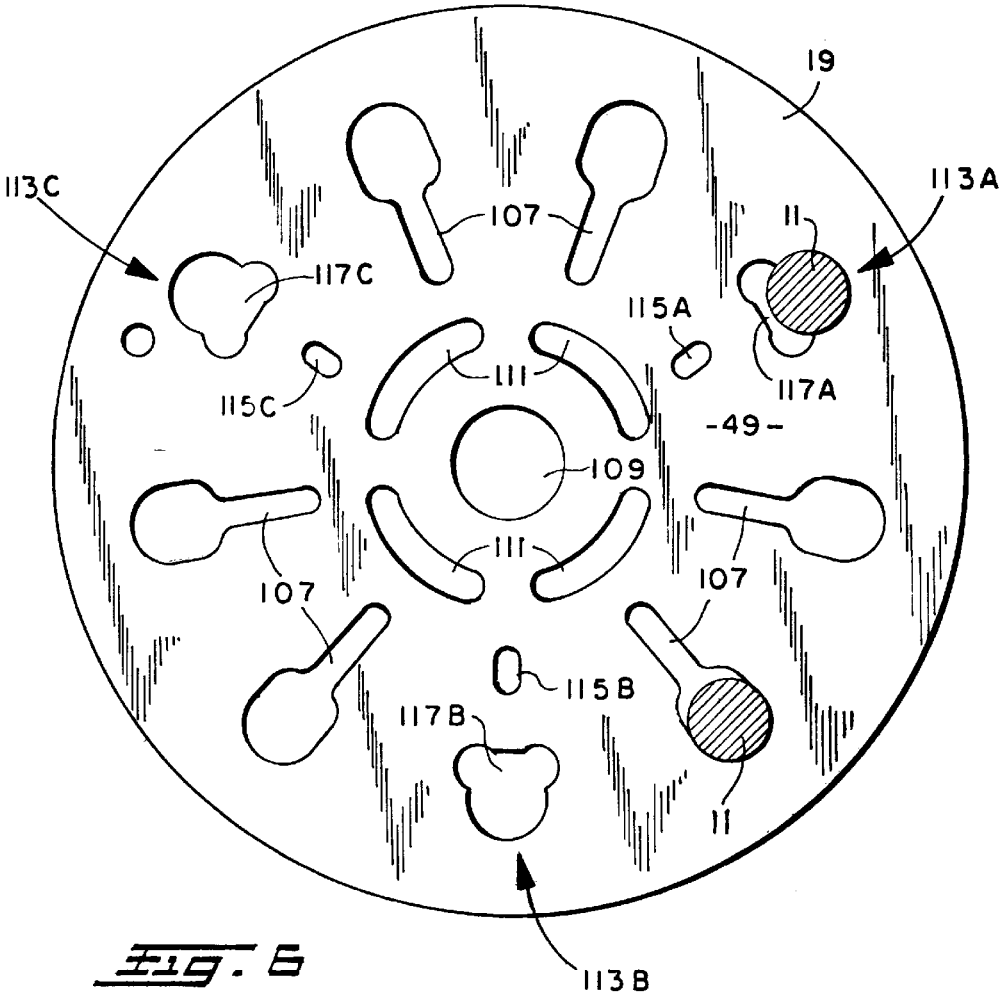
FIG. 6 is a transverse cross-section taken on line 6—6 of FIG. 1, but with most of the bolts removed for ease of illustration, and showing the stationary valve plate made in accordance with the present invention.

Referring now primarily to FIG. 6, the stationary valve plate 19 will be described in some detail, keeping in mind that FIG. 6 is a view looking in a direction opposite FIGS. 1A, 3 and 4. As is well known to those skilled in the art of VIS-type motors, the stationary valve plate would, in a conventional VIS motor, be either immediately adjacent the end cap, or may even be formed integrally with the end cap. However, for reasons which will become apparent subsequently, the stationary valve plate 19 is, in the present invention, separated from the end cap 13 by the spacer plate 15 and shifter plate 17, in order to accomplish the two-speed valuing of the invention. The stationary valve plate 19 defines a plurality of stationary valve passages 107, also referred to in the art as "timing slots".

In the subject embodiment, each of the valve passages 107 would typically comprise a radially-oriented slot, each of which would be disposed in continuous, open fluid communication with an adjacent one of the volume chambers, either an expanding volume chamber 33E, or a contracting volume chamber 33C. Preferably, the valve passages 107 are disposed in a generally annular pattern which is concentric relative to a central opening 109. Surrounding the central opening 109 is an annular pressure chamber, including a plurality of individual stationary pressure ports 111. If the stationary valve plate 19 were made in accordance with the teachings of prior art, there would be nine of the valve passages 107, one for each of the volume chambers 33. However, in accordance with one important aspect of the invention, there are six of the stationary valve passages 107 and three other, different stationary valve passages, generally designated 113A, 113B and 113C which differ from the conventional valve passages 107 in a manner to be described. The fact that there are six of the passages 107, and three of the passages 113 is by way of example only, and those skilled in the art will understand that the number of each type of passage could vary somewhat.

As is also well known to those skilled in the art, in the conventional VIS motor, the radially inner portion of each of the valve passages 107 is in commutating communication with the fluid ports 51 and 55, whereas the radially outer portion of each of the valve passages 107 is in permanent, continuous communication with the respective volume chamber. In other words, communication from one of the fluid ports 51 or 55 to the adjacent volume chamber is effected through the radially oriented valve passage 107 in which the radially inner portion and the radially outer portion are in direct, open fluid communication.

By way of contrast, in the stationary valve passages 113A, 113B and 113C of the present invention, there are radially inner (upstream) portions 115A, 115B and 115C, respectively and radially outer (downstream) portions 117A, 117B and 117C, respectively. It should be noted that in FIG. 6, for ease of illustration, several of the bolts 11 are shown, simply to illustrate the effective flow area remaining after the bolt is inserted. Therefore, in accordance with an important aspect of the present invention, in the stationary valve passages 113A, 113B and 113C, the radially inner portions (e.g., 115A) and the radially outer portions (e.g., 117A), are not in direct, open fluid communication. Instead, the radially inner and outer portions are in communication with each other, through the control valve spool 89, in the normal, low-speed, high-torque mode (see FIG. 8), but are blocked from communication with each other by the control valve spool 89 in the high-speed, low-torque mode (see FIG. 9). The low speed and high speed modes will be described in greater detail subsequently in connection with the description of the operation of the invention.

Figure 7:
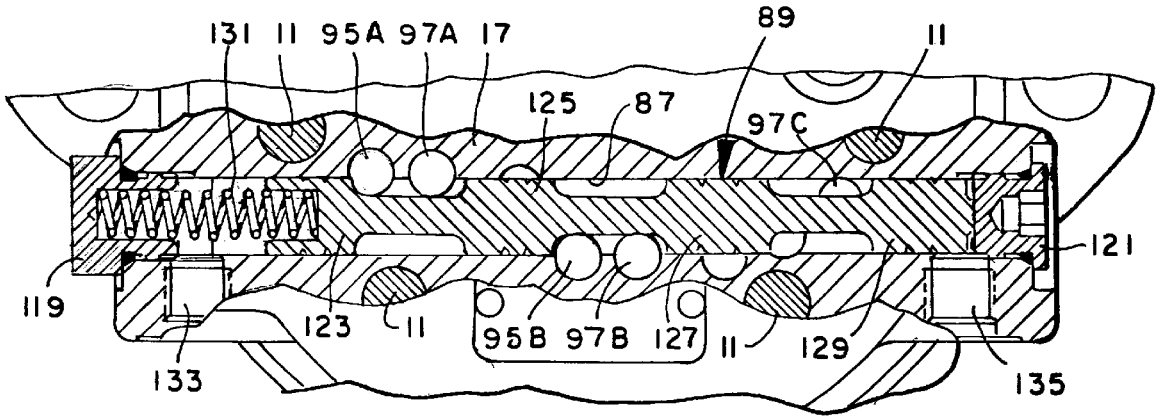
FIG. 7 is a fragmentary, transverse cross-section, taken on line 7—7 of FIG. 1 and showing the control valve portion of the present invention.

Referring now primarily to FIG. 7, the general structure of the control valuing of the present invention will be described. It should be noted that in FIG. 7, the control valve spool 89 is shown in the normal, low speed mode. In FIG. 7, which is being viewed in the same direction as FIG. 4, the opposite transverse ends of the spool bore 87 are sealed by threaded plugs 119 and 121. The control valve spool 89 includes a plurality of lands 123, 125, 127 and 129. Both the plug 119 and the land 123 are partially hollow, and serve as the seats for a biasing spring 131, which tends to bias the spool 89 toward the right in FIG. 7, i.e., toward the low-speed mode of operation. The shifter plate 17 defines a pair of pilot ports 133 and 135, by means of which the position of the control valve spool 89 can be selected, using an appropriate pilot pressure. By way of example only, in a closed loop propel system, the pressure from the charge pump (typically 200 to 400 psi) could serve as the pilot pressure. Those skilled in the art will understand that the details of the control valuing are not essential features of the present invention, except to the extent so indicated hereinafter, and in the appended claims. For example, the control valve spool 89 could also be actuated by other than hydraulic means, such as by a solenoid.

Operation

Figure 8:
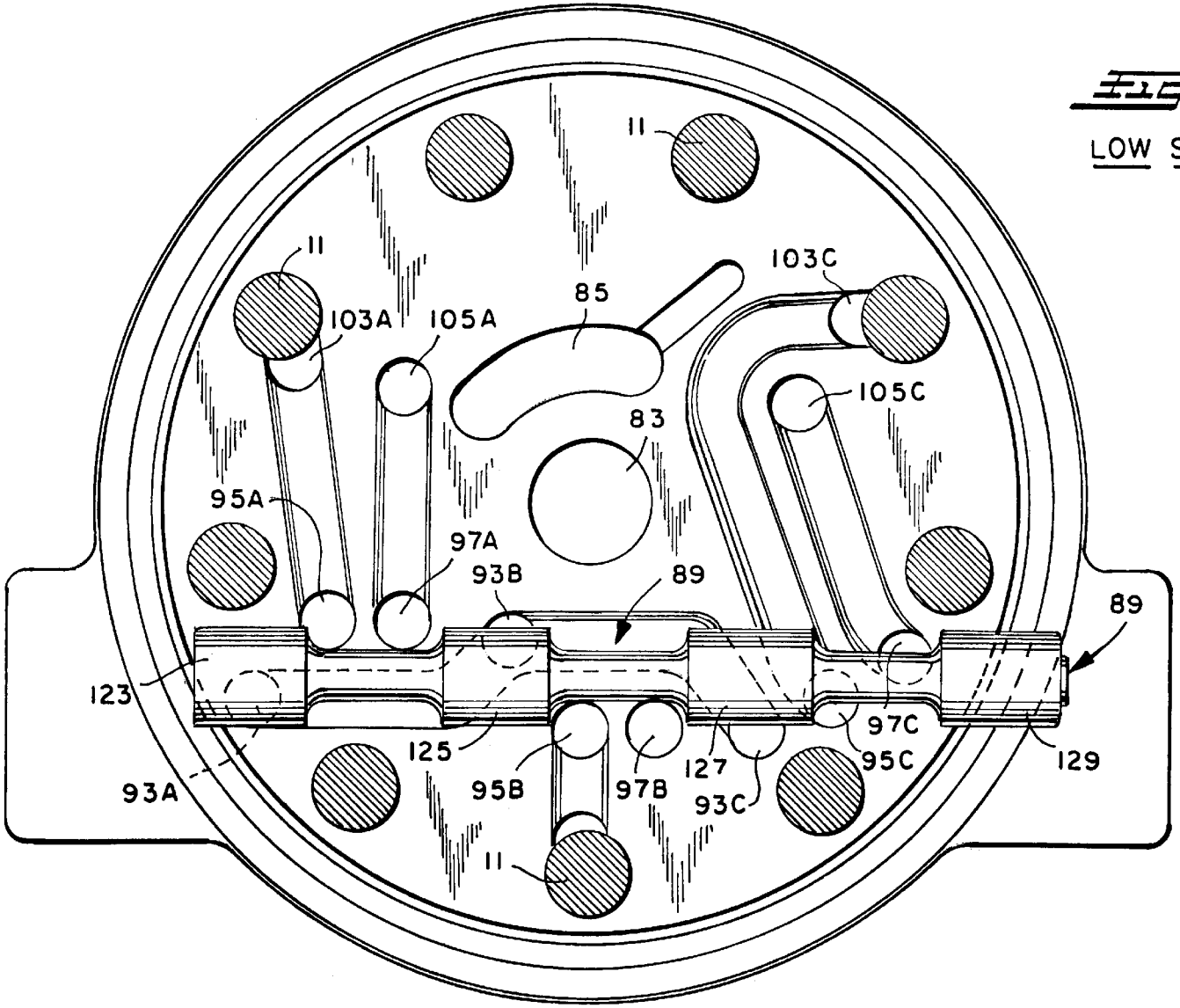
Figure 5:
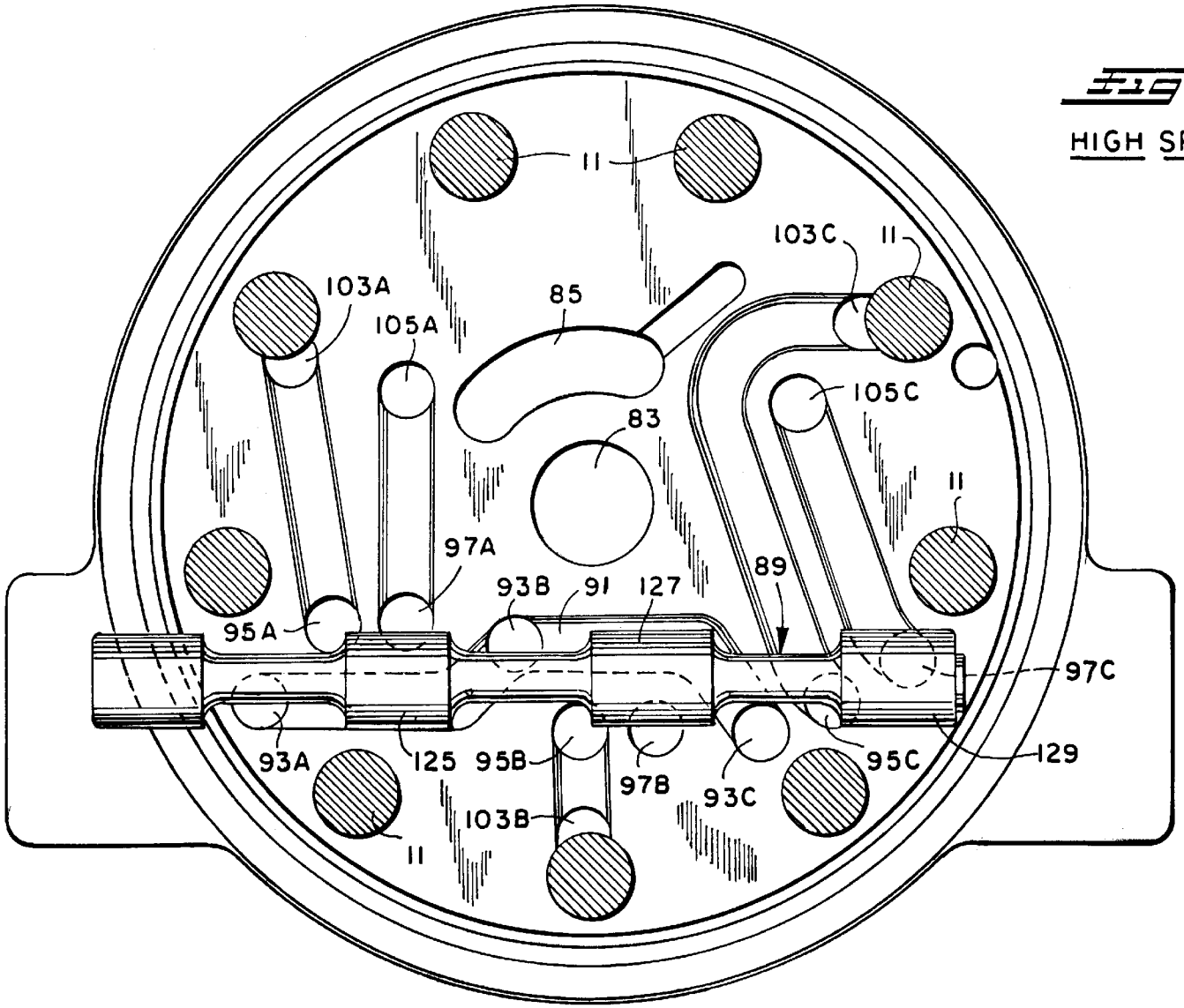

Referring now primarily to FIG. 8, the operation of the motor of the present invention in the low-speed, high-torque mode will be described. When it is desired to operate in the low speed mode, the pilot port 135 is drained, and the pilot port 133 would typically also be drained, such that the biasing spring 131 biases the control valve spool 89 to the right, to the position shown in FIGS. 7 and 8. It should be understood that FIGS. 8 and 9 are somewhat schematic in showing the relationship of the control valve spool 89 to the various bores, but in the low speed mode, and as is shown in FIG. 8, the lands 123, 125 and 127 block the recirculation bores 93A, 93B and 93C, respectively. However, communication is permitted between the pocket bore 95A and the valve bore 97A, and between the pocket bore 95B and the valve bore 97B, and between the pocket bore 95C and the valve bore 97C. The result is somewhat indirect, but relatively unrestricted communication between the pocket port 103A and the valve port 105A, between the pocket port 103B and the valve port 105B, and between the pocket port 103C and the valve port 105C. The further result is somewhat indirect, but relatively unrestricted communication between the portions 115A and 117A, between the portions 115B and 117B, and between the portions 115C and 117C.

Thus, with the motor operating in the low speed mode, and assuming high pressure at the inlet port 59, high pressure is communicated through the passage 69 to the cylindrical chamber 67, through the central openings 73, 83 and 109 and into the central manifold zone 45, then through the fluid passages 53 to the fluid ports 51. The fluid ports 51 which are on the left side of the vertical line in FIG. 1A are in commutating fluid communication with the various timing passages which, in turn, are in communication with the expanding volume chambers 33E. High pressure in the chambers 33E causes the star member 31 to orbit in a counter-clockwise direction, while rotating in a clockwise direction, in a manner well known to those skilled in the art, and which requires no further explanation. At the same time, low pressure fluid is being exhausted from the contracting volume chambers 33C, flowing through the timing slots which are in communication with the fluid ports 55 on the right side of the vertical line in FIG. 1A. The low pressure fluid is then communicated from the fluid ports 55 through the portions 57 into the pressure ports 111, then into the annular groove 101 communicating with the kidney-shaped passage 85. This low pressure fluid then flows through the kidney-shaped passage 75 and into the annular chamber 65 from where the low pressure fluid flows to the outlet port 61.

When the motor is operating in the low-speed, high-torque mode, as described above, whenever one of the high pressure fluid ports 51 communicates with the radially inner portion 115A, the high pressure fluid then flows into the valve port 105A, and then to the valve bore 97A. As may best be seen in FIG. 8, with the control valve spool 89 in the low speed position, the valve bore 97A is in open communication with the pocket bore 95A, such that the high pressure fluid flows from there through the connecting passage to the pocket port 103A, and into the radially outer portion 117A, which is in communication with an adjacent expanding volume chamber 33E (at about the ten o'clock position in FIG. 1A). A similar flow path occurs from the contracting volume chamber 33C at about the two o'clock position in FIG. 1A through the radially outer portion 117C and eventually from the pocket bore 95C to the valve bore 97C to the radially inner portion 115C. In other words, in the low speed mode, the operation of the motor is the same as if the radially outer portions 117A and 117C were in direct, open communication with the radially inner portions 115A and 115C, respectively (as is the case with the stationary valve passages 107).

No comment has been made with regard to the radially outer and inner portions 117B and 115B because, with the gerotor gear set 21 in the position shown in FIG. 1A, the volume chamber 33 at the six o'clock position is a "transition" chamber, i.e., it is instantaneously at the minimum possible volume and is in the process of changing from a contracting volume chamber to an expanding volume chamber. However, those skilled in the art will understand that as soon as the star 31 orbits and rotates away from the position shown in FIG. 1A, fluid would be communicated to that transition volume chamber through the stationary valve passage 113B, in the same manner as described in regard to the passage 113A.

When it is desired to operate the motor in the high-speed, low-torque mode, i.e., by effectively reducing the displacement of the gerotor gear set 21 by recirculating some of the fluid, appropriate pilot signals are communicated to the pilot port 135, biasing the control valve spool 89 toward the right in FIG. 7, toward the position shown in FIG. 9. With the valve spool 89 in the high speed position, and assuming that the star 31 is still in the position shown in FIG. 1A, high pressure fluid in the fluid port 51 (at about the ten o'clock position) flows into the radially inner portion 115A, but pressurized fluid in the portion 115A then flows through the valve port 105A to the valve bore 97A. However, high pressure fluid in the bore 97A cannot enter the spool bore 87 because the valve bore 97A is now blocked by the land 125. Similarly, no low pressure exhaust fluid from the radially inner portion 115C flows into a commutating fluid port 55 because such exhaust fluid would have to flow from the valve bore 97C, but such flow cannot occur because the bore 97C is now blocked by the land 129. In the same manner, the valve bore 97B is blocked by the land 127.

It should be noted by comparing FIGS. 8 and 9 that, through the range of movement of the control valve spool 89, the pocket bores 95A, 95B and 95C are always in open communication with the spool bore 87. As the control valve spool 89 moves from the low speed position of FIG. 8 toward the high speed position of FIG. 9, communication between the pocket bores 95 and the valve bores 97 is first discontinued, and then communication is opened between the pocket bores 95A, 95B and 95C and the recirculation bores 93A, 93B and 93C, respectively. As may best be seen in FIG. 4, and as was described previously, the three recirculation bores 93A, 93B and 93C are all in open communication with the recirculation passage 91. Therefore, at the instant in time represented in FIG. 1A, the pocket bore 95B is in communication with the recirculation bore 93B, but the pocket bore 95B is in communication with the transition chamber, as described previously, such that, instantaneously, no fluid is communicated from the recirculation bore 93B into or out of the recirculation passage 91. At that same instant however, the expanding volume chamber 33E and the contracting volume chamber 33C which are in communication with the pocket ports 103A and 103C, respectively, are changing volume at about the same rate, but in opposite "directions", i.e., one is expanding and the other is contracting. Thus, for the expanding volume chamber 33E, a certain volume of high pressure fluid is flowing into the volume chamber from the recirculation passage 91, and at the same time, for the contracting volume chamber 33C, which also now contains high pressure fluid, about the same volume of fluid is exhausted into the recirculation passage 91.

It should be understood by those skilled in the art that the operation of the present invention in the high speed mode is not dependent upon the instantaneous volume of the three volume chambers which are connected to the recirculation passage 91 remaining constant. Therefore, although the present invention is illustrated in connection with an 8-9 gerotor gear set, the use of the present invention is not so limited, but could be used with various other combinations of numbers of external and internal teeth.

Also, the present invention has been illustrated and described in connection with a particular embodiment in which the commutating valuing is of the VIS (valve-in-star) type, but it should be understood that the use of the present invention is also not so limited. At least conceptually, the invention could be used with any type of low speed, commutating valuing for a motor of the type having a fluid pressure displacement mechanism defining volume chambers which alternate between an expanding state and a contracting state, wherein there are stationary valve passages having an upstream portion involved in the commutating valuing, and a downstream portion involved in open communication with the volume chambers.

In the subject embodiment of the invention, the various bores and lands shown in FIGS. 8 and 9 are arranged such that flow from each of the valve bores 97 to its respective pocket bore 95 is opened or closed at the same time, and similarly, communication between each of the recirculation bores 93 and its respective pocket bore 95 is opened or closed at the same time. Thus, in shifting between the low speed and high speed modes, the entire ratio change occurs in one step, i.e., the three recirculating volume chambers all begin to recirculate at the same time or all stop circulating at the same time and, for example, the motor shifts from a 1.0:1 ratio directly to a 1.5:1 ratio directly, with no intermediate ratios occurring.

However, it is believed to be within the ability of those skilled in the art, from a reading and understanding of the above specification, to provide intermediate ratios. Furthermore, it is one important aspect of the present invention that, because the recirculation flow does not pass through the commutating valuing, but instead passes through a separate, external control valve (control valve spool 89), such intermediate ratios may be provided. As used herein, the term "external" simply refers to the fact the control of the recirculation is through valuing which is separated from the normal commutating motor valuing. The provision of intermediate ratios is related to the observation made previously that the operation of the present invention does not require a constant total volume of the recirculating pockets, as would be the case if the communication among the recirculating pockets were through the commutating valuing. Instead, with the communication among the recirculating pockets being through the separate, external control valuing, there is the possibility of much greater flexibility in controlling the flow of recirculating fluid.

Figure 10:
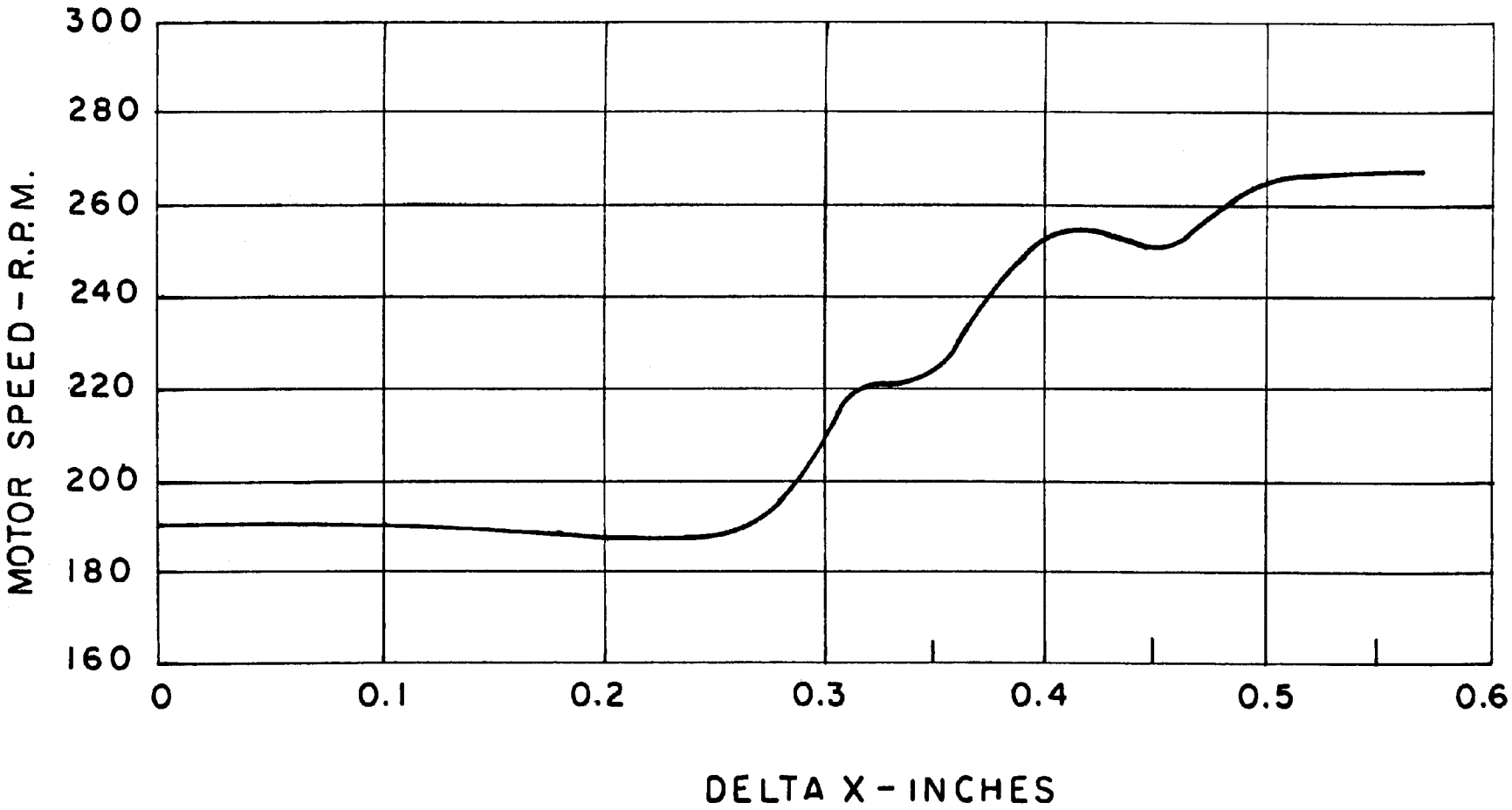
FIG. 10 is a graph showing motor speed (in RPM) as a function of change in control valve spool position (Delta X, in inches) from the low-speed, high-torque mode.

As one example, the subject embodiment could be modified such that the timing of the lands 125, 127 and 129 closing the valve bores 97 and opening the recirculation bores 93 would be varied, so that the 3 closings and 3 openings would not occur simultaneously. It will be understood by those skilled in the art that this alternative is not shown in a separate drawing because, in order to provide "timed" or multi-step shifting in the subject embodiment, a change of land spacing on the order of only about 0.050 inches (1.27 mm) was needed. Referring now to the graph of FIG. 10, by adjusting the axial spacing of the beginning and ending of the various lands relative to the bores in the A, B, and C groups, it would be possible, when shifting from low speed to high speed to shift first from the 1.0:1 ratio to a 1.13:1 ratio, then to a 1.29:1 ratio, and finally to the 1.50:1 high speed ratio.

As will be appreciated by those skilled in the art, such a multi-step change in the ratio would substantially reduce the abruptness of the shift and therefore would be much more acceptable to the vehicle operator, whether shifting from high speed to low speed or from low speed to high speed.

Although most gerotor motors have a stationary ring member, and an orbiting and rotating star member, there are various other configurations which are known. For example, it is known to provide a star member having purely rotational movement, with the ring member being restrained for only orbital movement. In that case, the stationary valve member may still be literally stationary relative to the motor housing, or may be permitted to orbit in the same manner as the ring member, recognizing that the purpose of the stationary valve member is to port fluid to the volume chambers. Therefore, it will be understood that the term "stationary" may include a valve member having some movement, but still being generally fixed relative to the volume chambers, and able to feed the volume chambers. The invention thus includes within its scope such other gerotor and motor configurations, and whatever variations are required for the multi-speed capability of the present invention to be operable with such other motor and gerotor configurations.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A fluid pressure operated device comprising housing means defining a fluid inlet port and a fluid outlet port; a fluid pressure displacement mechanism associated with said housing means and including an internally-toothed ring member and an externally-toothed star member eccentrically disposed within said ring member; said ring member and said star member having relative orbital and rotational movement, and interengaging to define a plurality N of expanding and contracting fluid volume chambers in response to said orbital and rotational movement; motor valve means cooperating with said housing means to provide fluid communication between said fluid inlet port and said expanding volume chambers, and between said contracting volume chambers and said fluid outlet port; said motor valve means comprising a stationary valve member fixed to be non-rotatable relative to said housing means, and a moveable valve member, operable to move relative to said stationary valve member in synchronism with one of said orbital and rotational movements; said stationary valve member defining a plurality N of stationary valve passages, each of said stationary valve passages including an upstream passage portion adapted for commutating fluid communication with said moveable valve member, and further including a downstream passage portion in continuous fluid communication with one of said plurality N of fluid volume chambers; and, in a plurality of said stationary valve passages, said upstream passage portion and said downstream passage portion being in direct, relatively unrestricted, continuous fluid communication; characterized by:

(a) in a plurality M of said stationary valve passages, said upstream and said downstream passage portions being blocked from direct fluid communication;

(b) control valve means operably associated with said stationary valve member, and operable in a first position to provide relatively unrestricted fluid communication between each upstream passage portion and its respective downstream passage portion, and operable in a second position to block fluid communication between each upstream passage portion and its respective downstream passage portion.

2. A fluid pressure operated device as claimed in claim 1, characterized by said control valve means being operable, in said second position to provide relatively unrestricted fluid communication among said plurality M of downstream passage portions.

3. A fluid pressure operated device as claimed in claim 2, characterized by said control valve means cooperating with one of said stationary valve member and said housing means to define a fluid accumulation region, said control valve means, in said second position, providing relatively unrestricted fluid communication between each of said plurality M of downstream passage portions and said fluid accumulation region.

4. A fluid pressure operated device as claimed in claim 3, characterized by said fluid accumulation region being in fluid communication with a source of relatively high pressure fluid.

5. A fluid pressure operated device as claimed in claim 4, characterized by said source of relatively high pressure fluid comprises said fluid inlet port.

6. A fluid pressure operated device as claimed in claim 1, characterized by said control valve means including a plurality M of separate valve portions, each having said first position and said second position, each of said separate valve portions making a transition from said first position to said second position at a different time, whereby said fluid pressure operated device changes between a minimum speed ratio and a maximum speed ratio by one fluid volume chamber at a time.

7. A fluid pressure operated device comprising housing means defining a fluid inlet port and a fluid outlet port; a fluid pressure displacement mechanism associated with said housing means and including a first member and a second member operably associated with said first member; said first member and said second member having relative movement, and interengaging to define a plurality N of expanding and contracting fluid volume chambers in response to said relative movement; motor valve means cooperating with said housing means to provide fluid communication between said fluid inlet port and said expanding volume chambers, and between said contracting volume chambers and said fluid outlet port; said motor valve means comprising a stationary valve member fixed to be non-rotatable relative to said housing means, and a moveable valve member, operable to move relative to said stationary valve member in synchronism with said relative movement; said stationary valve member defining a plurality N of stationary valve passages, each of said stationary valve passages including an upstream passage portion adapted for commutating fluid communication with said moveable valve member, and further including a downstream passage portion in continuous fluid communication with one of said plurality N of fluid volume chambers; and, in a plurality of said stationary valve passages, said upstream passage portion and said downstream passage portion being in direct, relatively unrestricted, continuous fluid communication; characterized by:

(a) in a plurality M of said stationary valve passages, said upstream and said downstream passage portions being blocked from direct fluid communication;

(b) control valve means operably associated with said stationary valve member, and operable in a first position to provide relatively unrestricted fluid communication between each upstream passage portion and its respective downstream passage portion, and operable in a second position to block fluid communication between each upstream passage portion and its respective downstream passage portion.

8. A fluid pressure operated device as claimed in claim 7, characterized by said control valve means being operable, in said second position to provide relatively unrestricted fluid communication among said plurality M of downstream passage portions.

9. A fluid pressure operated device as claimed in claim 8, characterized by said control valve means cooperating with one of said stationary valve member and said housing means to define a fluid accumulation region, said control valve means, in said second position, providing relatively unrestricted fluid communication between each of said plurality M of downstream passage portions and said fluid accumulation region.

10. A fluid pressure operated device as claimed in claim 9, characterized by said fluid accumulation region being in fluid communication with a source of relatively high pressure fluid.

11. A fluid pressure operated device as claimed in claim 10, characterized by said source of relatively high pressure fluid comprises said fluid inlet port.

12. A fluid pressure operated device as claimed in claim 7, characterized by said control valve means including a plurality M of separate valve portions, each having said first position and said second position, each of said separate valve portions making a transition from said first position to said second position at a different time, whereby said fluid pressure operated device changes between a minimum speed ratio and a maximum speed ratio by one fluid volume chamber at a time.

* * * * *